US006746324B2

(12) United States Patent
Achen

(10) Patent No.: US 6,746,324 B2
(45) Date of Patent: Jun. 8, 2004

(54) COMBUSTION AIR WALL VENT

(76) Inventor: John J. Achen, 12432 Del Rico, Yuma, AZ (US) 85367

( * ) Notice: Subject to any disclaimer, the term of this patent is extended or adjusted under 35 U.S.C. 154(b) by 0 days.

(21) Appl. No.: 10/242,890

(22) Filed: Sep. 13, 2002

(65) Prior Publication Data

US 2004/0053572 A1 Mar. 18, 2004

(51) Int. Cl.[7] ..... F24F 7/10
(52) U.S. Cl. ..... 454/283; 454/276; 454/277
(58) Field of Search ..... 454/371, 48, 254, 454/273, 275, 286, 277, 283; 55/355.2, 501, 506

(56) References Cited

U.S. PATENT DOCUMENTS

| | | | | |
|---|---|---|---|---|
| 637,519 | A | | 11/1899 | Mertins |
| 2,790,376 | A | | 4/1957 | Kennedy et al. ..... 98/114 |
| 2,930,309 | A | | 3/1960 | Prager ..... 98/118 |
| 3,740,934 | A | | 6/1973 | Shuler ..... 55/490 |
| 3,791,280 | A | * | 2/1974 | Williamson ..... 454/283 |
| 3,964,376 | A | | 6/1976 | Janke ..... 98/59 |
| 4,469,018 | A | | 9/1984 | Taulman ..... 98/37 |
| 4,550,648 | A | | 11/1985 | Eagle ..... 98/37 |
| 4,592,271 | A | | 6/1986 | Young ..... 98/114 |
| 4,676,145 | A | | 6/1987 | Allred ..... 98/29 |
| 4,699,045 | A | | 10/1987 | Hensley ..... 98/37 |
| 4,754,696 | A | | 7/1988 | Sarazen et al. ..... 98/29 |
| 4,770,087 | A | | 9/1988 | Danley et al. ..... 98/87 |
| 4,911,066 | A | | 3/1990 | Carew ..... 98/121.1 |
| 5,120,273 | A | | 6/1992 | Lin ..... 454/195 |
| 5,194,038 | A | | 3/1993 | Klomhaus et al. ..... 454/162 |
| 5,293,920 | A | * | 3/1994 | Vagedes ..... 160/89 |
| 5,349,799 | A | | 9/1994 | Schiedegger et al. ..... 52/473 |
| 5,394,663 | A | | 3/1995 | Jackson ..... 52/199 |
| 5,487,701 | A | | 1/1996 | Schedegger et al. ..... 454/271 |
| 5,590,477 | A | | 1/1997 | Carfagno, Sr. ..... 34/235 |
| 5,758,457 | A | | 6/1998 | Achen ..... 52/198 |
| 5,821,628 | A | * | 10/1998 | Hotta ..... 257/783 |
| 5,950,384 | A | * | 9/1999 | Aarness ..... 52/473 |
| 5,976,007 | A | | 11/1999 | Powell et al. ..... 454/48 |
| 5,976,009 | A | | 11/1999 | Achen ..... 454/195 |
| 6,012,260 | A | | 1/2000 | Hendrick et al. ..... 52/302.1 |
| 6,052,959 | A | * | 4/2000 | LaBrosse ..... 52/302.6 |
| 6,113,488 | A | | 9/2000 | Tiede ..... 454/276 |
| 6,431,980 | B1 | * | 8/2002 | Achen ..... 454/271 |

OTHER PUBLICATIONS

Brochure entitled "Clopay 4200/4201—Steel Insulated Raised Panel & Flush Garage Doors", by Clopay Corporation, 1993, (4 pages).
Catalog entitled "POLAR Hardware Mfg. Co., Inc.", Catalog No. 90, Chicago, Illinois (cover page, p. 69 and last page), undated.

* cited by examiner

*Primary Examiner*—Gregory A. Wilson
(74) *Attorney, Agent, or Firm*—Cahill, von Hellens & Glazer P.L.C.

(57) ABSTRACT

A combustion air vent for use with an extension wall of a building includes a louvered panel substantially in the plane of the stucco wall surface. Top, bottom, left and right side panels extend from the edges of the louvered panel for a distance substantially commensurate with the thickness of the stucco wall externally of the supporting wall framing. One or more bendable tabs are disposed in selected ones of the panels and adapted to be bent to secure an insect screen adjacent the interior surface of the louvered panel. Flanges extend from one or more of the top, bottom, left and right side panels. Fastening means secure selected ones of the flanges to the framing to retain the vent in place.

14 Claims, 2 Drawing Sheets

COMBUSTION AIR WALL VENT

BACKGROUND OF THE INVENTION

1. Field of the Invention The present invention relates to wall vents and, more particularly, combustion air wall vents adapted for use with exterior walls having a stucco type finish.

2. Description of Related Art

During the summertime in the southwest United States and in climatologically similar areas, the temperature in an unvented enclosed garage increases to well over 100° F. Such a high temperature may cause damage or deterioration to temperature sensitive items stored or otherwise disposed within such a garage. Moreover, the high temperatures render it very uncomfortable for a person working within the garage. To alleviate this problem, it is not uncommon to install vents in one or more exterior walls of a garage to permit airflow into and out of the garage.

The simplest of such vents are a louvered panel of relatively light weight material nailed or screwed to the exterior surface of a wall in juxtaposed relationship with the corresponding aperture. Such light weight louvered panels are easily removed by a person intending to commit mischief within the garage. Other more robust vents have been used in conventional walls which are designed to preclude removal from outside the wall.

In the southwest, stucco type walls are a common treatment to exterior walls. Existing vents for use with such walls generally fail to accommodate the unique properties attendant the construction of stucco wall surfaces and cause the vent and surrounding stucco to be unsightly and generally unacceptable from an aesthetic viewpoint. Additionally, sealing the junction between conventional vents and the stucco is of questionable merit and water readily flows therebetween as a result of rain or other wetting of the exterior wall.

Many residential garages have gas fired water heaters located therein. These heaters require make-up air to provide a continuing source of oxygen to maintain complete combustion and reduce the emission of deadly carbon monoxide. Many municipalities are redrafting or adopting building codes that require vents in an exterior wall enclosing a gas fired water heater. Generally, such vents must be within 12 inches of the ceiling and of the floor to insure an adequate source of make-up air through convection or otherwise. As mentioned above, many presently available vents for this purpose are either inadequate as security devices to preclude entry into the garage, are unsightly or compromise the integrity of the exterior wall against intrusion of elements.

SUMMARY OF THE INVENTION

A louvered panel is supported by top, bottom, left and right sidewalls forming a boxlike structure. Right angled flanges extend from the edges of the top, bottom, left and right sidewalls for attachment by nails or screws to an underlying frame defining the opening covered by the vent. A screen serving as an insect barrier is juxtaposed with the interior surface of the louvered panel and held in place by tabs bent inwardly from one or more of the top, bottom, left and right sidewalls. Upon bending of the tabs, slots are formed that may serve as openings through which the nails or screws are inserted to secure the vent in place. Thereby, the vent includes several labor saving features to minimize installation time. The depth of the top, bottom, left and right sidewalls corresponds with the width of conventional stucco wall construction external of the supporting studs (or framing) whereby the louvered panel is flush with the stucco wall and the stucco forms a weather tight seal about the vent.

It is therefore a primary object of the present invention to provide a labor saving easy to install combustion air vent for use with an exterior wall having a stucco finish.

Another object of the present invention is to provide a combustion air vent for an exterior wall which is impossible to remove without major damage to the exterior wall.

Still another object of the present invention is to provide a vent having an insect screen retained in place by bent tabs.

Yet another object of the present invention is to provide a combustion air vent precluding unwanted intrusion therethrough.

A further object of the present invention is to provide a combustion air vent secured in place prior to applying a stucco finish to the attendant exterior wall.

A still further object of the present invention is to provide a combustion air vent in sealed engagement with a surrounding stucco wall finish.

A yet further object of the present invention is to provide an easily installable combustion air vent and method for installing same.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
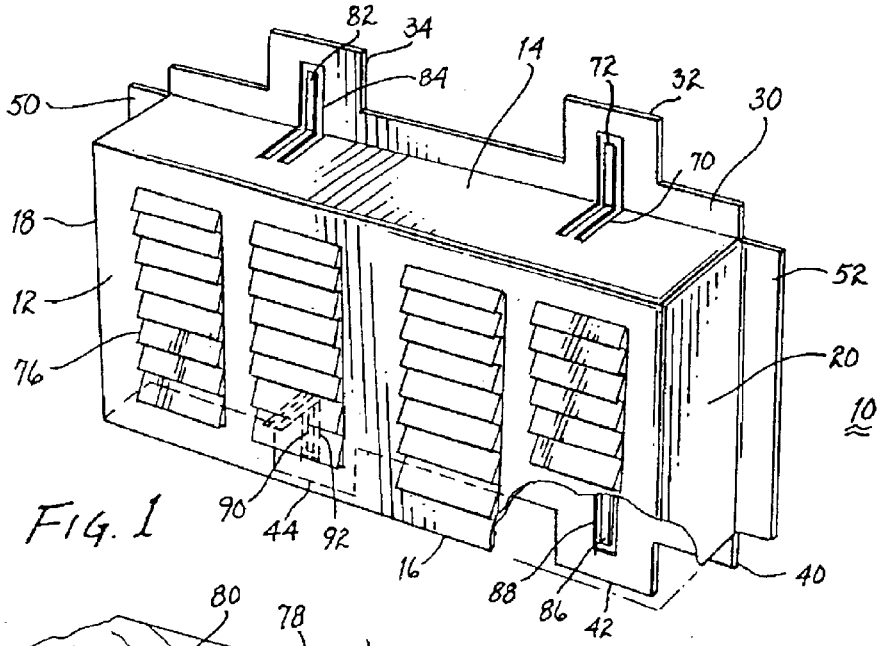
FIG. 1 is a perspective view of a combustion air vent particularly adapted for use with an exterior wall having a stucco finish.

Referring to FIG. 1, there is illustrated a combustion air wall vent 10 providing airflow through a louvered panel 12. The louvered panel is supported by top, bottom, left and right panels or sidewalls 14, 16, 18, 20, respectively. A flange 30 extends from top wall 14 at an angle of approximately 90 degrees. This flange may include a pair of extensions 32, 34 particularly adapted, as will be described below, for securing flange 30 to an underlying cross member extending between two wall studs. A similarly configured and oriented flange 40 extends from bottom wall 16; it may also include extensions 42, 44 for attachment to another cross member extending between wall studs. A flange 50 extends at approximately 90 degrees from left sidewall 18. This flange may be in juxtaposed relationship with a wall stud and be attached thereto, as described below. A flange 52, similar to flange 50, extends from right sidewall 20 for bearing against and attachment to an underlying wall stud.

Figure 2:
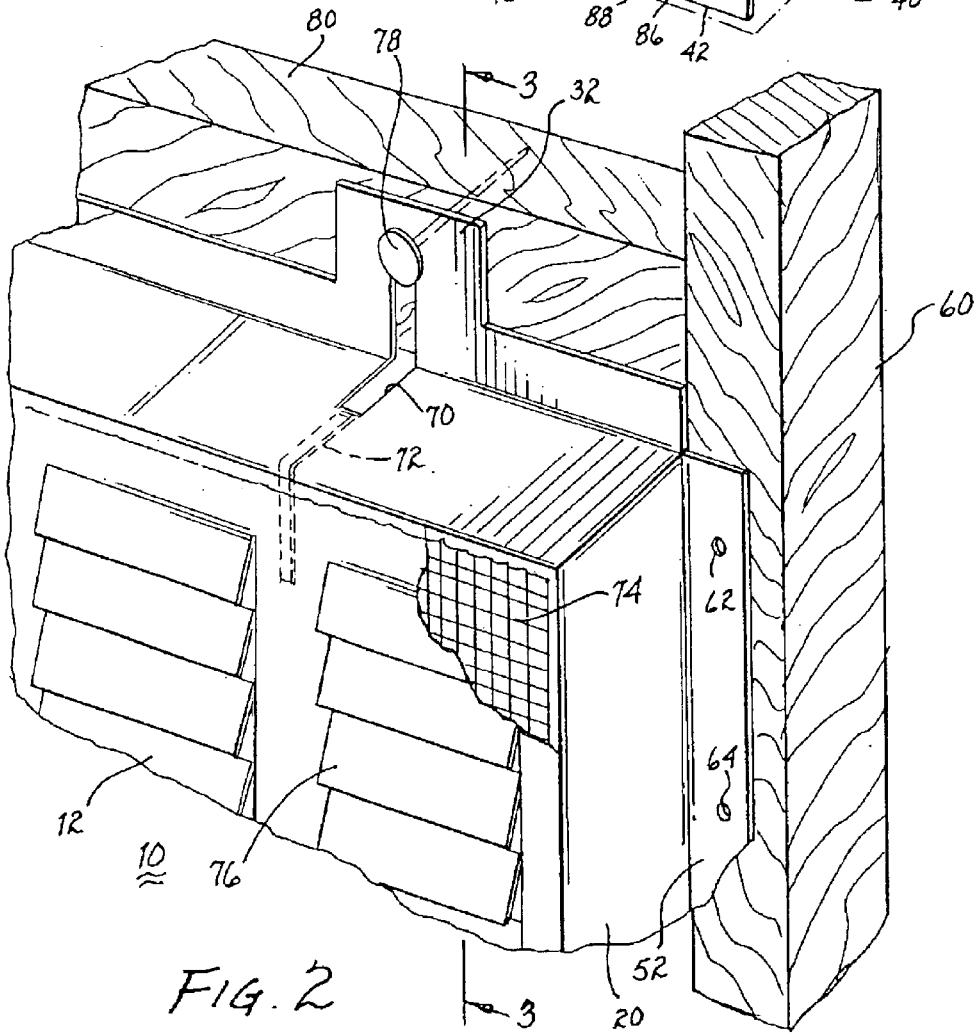
FIG. 2 is a partial view illustrating the attachment of the combustion air vent.
Figure 3:
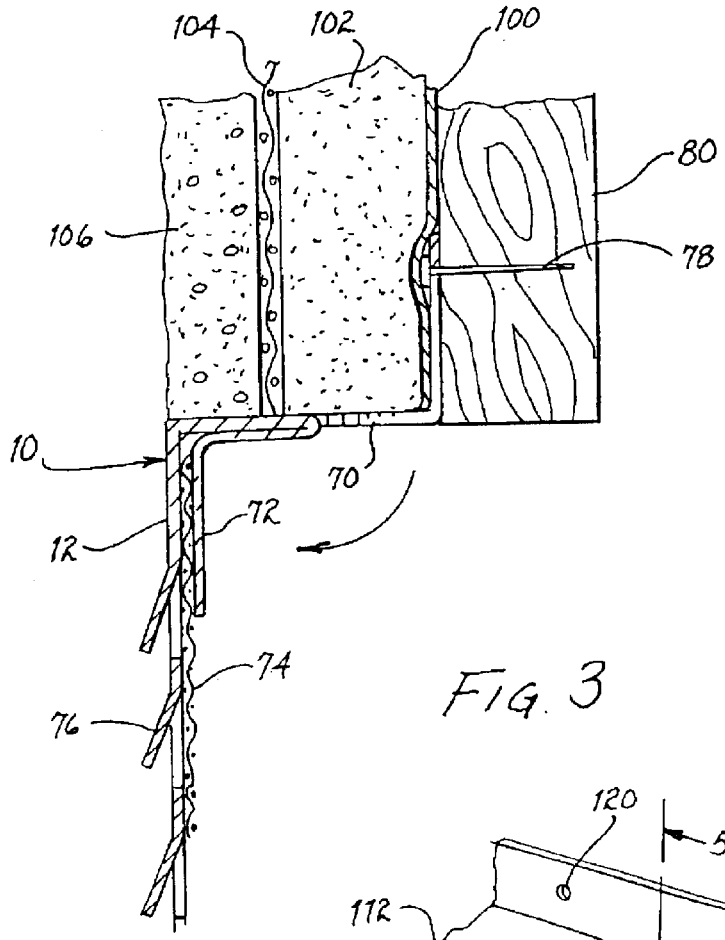
FIG. 3 is a cross-sectional view taken along lines 3—3, as shown in FIG. 2.

Referring jointly to FIGS. 2 and 3, further details of combustion air vent 10 will be described. Flange 52 is supported adjacent wall stud 60. The flange may be attached to this stud by screws, nails or other fastening means penetrably engaging apertures 62, 64 in flange 52. Extension 32 and part of top wall 14 includes a slot 70 formed to define a right angle tab 72 extending from top wall 14. An insect screen 74 of mesh or similar material is placed adjacent the inside surface of louvered panel 12 to preclude intrusion of insects through the apertures defined by louvers 76. Bending tab 72 approximately 180 degrees at its junction with top wall 14 will position a segment of the tab adjacent screen 74 and retain screen adjacent louvered panel 12, as particularly illustrated in FIG. 3. Slot 70 will now be open and a screw or nail 78 or other fastening means may be driven therethrough into cross member 80 to secure extension 32, and vent 10, to the cross member.

Extension 34 includes a similar tab 82 disposed within slot 84; this tab is also bent to hold screen 74 in place as described above with respect to tab 72. Extensions 40 and 44 include similar tabs 86, 90 disposed within slots 88, 92, respectively, and for the same purpose as tab 72. Moreover, slots 84, 88 and 92 serve as apertures through which a screw, nail or other fastening means may be inserted to engage an underlying cross member. It is to be noted that flange 50 (see FIG. 1), like flange 52, may include apertures for penetrably receiving screws, nails or other fastening means for engagement with an underlying wall stud.

As described above, combustion air vent 10 is secured to the framing of a wall; that is, to the vertical wall studs and cross members therebetween defining an aperture generally corresponding with the size of the vent. To obtain a stucco finish exterior of the wall framing, presently used conventional procedures and construction may be undertaken. As particular shown in FIG. 3, black paper 100, also known as moisture barrier paper, is attached to the framing by conventional means. Industry standard blue board 102 (or white board) is attached adjacent black paper 100 and serves primarily as an insulator. A mesh, such as chicken wire 104, is attached to blue board 102. The chicken wire serves to provide purchase for stucco 106 in the form of a paste troweled onto the chicken wire. Blue board 102 also serves the purpose of providing structural support for the stucco. Upon curing, the stucco forms a relatively hard surface with beneficial insulating properties.

As particularly illustrated in FIG. 3, the depth of combustion air vent 10 conforms with the thickness of the totality of the stucco wall construction. Furthermore, the stucco wall renders inaccessible nail 78, screws or other fastening means used to secure the vent in place. Thus, removal of the vent is impossible without destroying the surrounding parts of the stucco wall. Furthermore, the blue board is easily cut and fitted about the vent by making a series of straight cuts therein. Attachment of the chicken wire about the vent requires no more then a modicum of skill. The stucco paste is readily troweled about the vent and effectively seals the top, bottom, left and right sidewalls of the vent with the encircling stucco wall.

Figure 4:
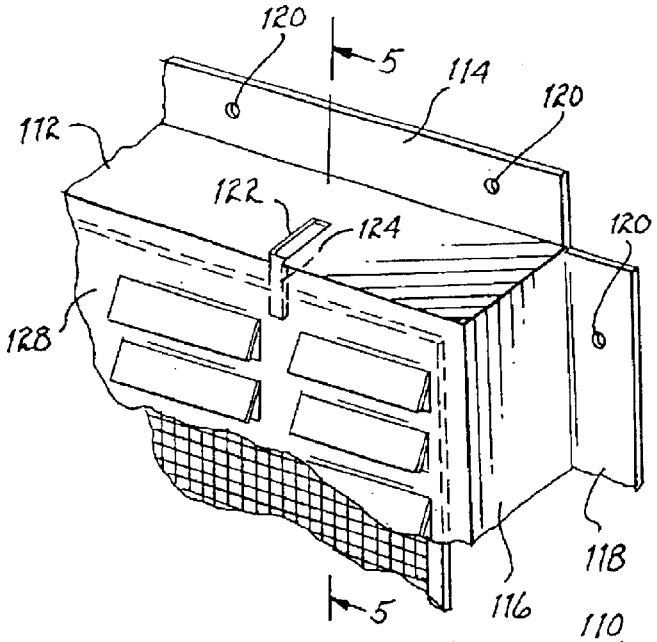
FIG. 4 is a partial perspective view illustrating a variant of the combustion air vent.
Figure 5:
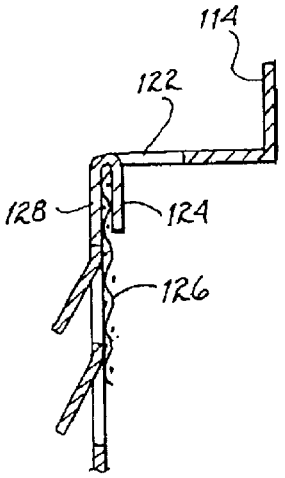
FIG. 5 is a cross-sectional view taken along lines 5—5, as shown in FIG. 4.

Referring jointly to FIGS. 4 and 5, there is shown a variant 110 of combustion air vent 10. Herein, top, bottom, left and right panels or sidewalls include right angled flanges, of which top wall 112, its flange 114 and right sidewall 16 and its flange 118 are shown. Each of the flanges includes one or more apertures 120 for penetrably receiving nails, screws or other fastening means may be used to attach variant 110 to the underlying wall studs and cross members. A slot 122 may be formed in one or more of the top, bottom, left side and right sidewalls to define a bendable tab 124. Each tab is bent approximately 90 degrees to locate the tab adjacent and retain insect screen 126 juxtaposed with louvered panel 128. As will be evident by inspection of FIG. 3, application of stucco 106 may fall through one or more of slots 122. Under normal circumstances, the stucco falling therethrough will be of no consequence. However, to prevent such intrusion of the stucco, a piece of tape or other material may be used to cover the slot after the respective tab is bent.

For purposes of minimizing the cost of vent 10 or variant 110, the vent may be formed from galvanized sheet material. Such sheet material may be of limited benefit in preventing intrusion through the underlying wall by purposefully damaging the louvered panel. To provide a high degree of security, vent 10 or variant 110 may be formed of steel of sufficient gauge to prevent destruction of the louvered panel except by extraordinary efforts. It is also contemplated that vent 10 or variant 110 may be formed of a plastic or other manmade material by conventional low cost processes.

In summary, vent 10 or variant 110 may be formed relatively inexpensively by presently well known manufacturing processes from any of various materials. The parts count is very low to enhance the low cost of manufacture, storage and shipping. Installation of the vent or the variant is easily performed by even low skilled artisans and may be rapidly performed which further enhances minimizing costs. Because the workman applying the stucco wall to the framing can easily accommodate the disruption caused by the vent or the variant to provide a uniform wall with little likelihood of error or mistake, little, if any, additional cost is incurred by forming the stucco wall about the vent or the variant. Finally, the louvered panel is essentially flush with the final wall surface and provides little, if any, aesthetic disruption to the final exterior wall.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function is substantially the same way to achieve the same result are within the scope of the invention.

I claim:

1. A combustion air vent for use in stucco walls, said vent comprising in combination:

a) a box including a louvered panel, top, bottom, left and right side panels, and a flange extending from at least one of said panels;

b) an insect screen disposed adjacent the interior of said louvered panel;

c) at least one tab extending from at least one of said panels for retaining said insect screen adjacent said louvered panel; and d) a flange extending from each of said top and bottom panels, at least a slot extending from said top panel into the corresponding one of said flanges and a tab extending within each of said at least one slot from said top panel and adapted to be bent to a position adjacent said insect screen, at least a further slot extending from said bottom panel into the corresponding one of said flanges and a further tab extending within each of said at least further slots and adapted to be bent to a position adjacent said insect screen.

2. A combustion air vent as set forth in claim 1 wherein at least one of said flanges includes an aperture for penetrably receiving fastening means for securing said at least one flange to framing of the stucco wall.

3. A combustion air vent as set forth in claim 1 including a flange extending from each of said left and right side panels and adapted to receive at least one aperture in each of said flanges extending from said left and right side panels upon penetration of fastening means to secure said flanges to framing of the stucco walls.

4. A combustion air vent as set forth in claim 1 wherein at least one of said tabs is formed as part of at least one of said top panel and said bottom panel.

5. A combustion air vent as set forth in claim 4 wherein each of said tabs is formed to define an L shape having a first leg and a second leg.

6. A combustion air vent as set forth in claim 5 wherein each of said second legs is adapted to bear against said insect screen upon bending of said tabs.

7. A combustion air vent as set forth in claim 4 wherein each of said tabs extends from a location proximate the junction between said louvered panel and the respective one of said top panel and said bottom panel.

8. A combustion air vent as set forth in claim 1 wherein the distance from said flanges to said louvered panel is commensurate with the thickness of the black paper, blue board, chicken wire and stucco used to form a conventional stucco wall attached to framing of a building exterior wall.

9. An air vent adapted to be attached to the framing of a building wall, said vent comprising in combination:

a) a louvered panel;

b) an insect screen adapted to be disposed adjacent said louvered panel;

c) a plurality of tabs adapted to be bent to retain said insect screen adjacent said louvered panel;

d) a plurality of flanges adapted to be secured to the framing to retain said vent in place;

e) panels extending from the edges of said louvered panel for supporting said flanges; and f) each of said tabs extending from an edge of a slot disposed in at least one of said panels.

10. An air vent as set forth in claim 9 wherein at least one of said flanges includes aperture means for penetrably receiving fastening means to secure the corresponding one of said flanges to the framing.

11. An air vent as set forth in claim 9 wherein said panels include top, bottom, left and right side panels.

12. An air vent as set forth in claim 11 wherein each flange of said plurality of flanges extends from one of said top, bottom, left and right side panels.

13. A method for mounting a combustion air vent upon framing of an extension wall, said method comprising the steps of:

a) placing an insect screen adjacent the inside of a louvered panel, which louvered panel is supported by top, bottom, left and right panels;

b) bending at least one tab from an edge of a slot disposed in at least one of the top, bottom, left and right panels adjacent the insect screen to retain the insect screen in place; and c) fastening at least one flange of the vent to the framing.

14. The method as set forth in claim 13 including the step of applying the materials of a conventional stucco wall, including a moisture barrier, blue board, chicken wire and stucco, adjacent the framing and circumscribingly about the vent to locate the louvered panel substantially in the plane of the finished stucco wall.

* * * * *